US005868288A

United States Patent [19]

Redmond, Sr. et al.

[11] Patent Number: 5,868,288

[45] Date of Patent: Feb. 9, 1999

[54] DISPENSING CONTAINER WITH CONCEALED LUGS

[75] Inventors: Thomas M. Redmond, Sr., Victoria; Timothy E. Fitten, Chaska, both of Minn.; Linda C. Nash, Weston, Conn.; Robin Laraine Doyle, Hanover, Minn.

[73] Assignee: Bristol-Myers Squibb Company, New York, N.Y.

[21] Appl. No.: 804,177

[22] Filed: Feb. 21, 1997

[51] Int. Cl.[6] ..... B65D 37/00

[52] U.S. Cl. ..... 222/562; 222/185.1; 222/212; 53/411; 53/415; 156/DIG. 27

[58] Field of Search ..... 222/212, 562, 222/494, 185.1; 215/330, 331; 156/538, 556, DIG. 27, DIG. 49, DIG. 37; 101/38.1; 53/411, 415

[56] References Cited

U.S. PATENT DOCUMENTS

| | | | |
|---|---|---|---|
| 3,363,546 | 1/1968 | Johnson | 156/DIG. 27 |
| 3,977,557 | 8/1976 | Hazard | 215/330 |
| 4,529,469 | 7/1985 | Jorss | 156/360 |
| 4,834,251 | 5/1989 | Yu | 215/330 |
| 5,033,655 | 7/1991 | Brown | 222/212 |
| 5,145,080 | 9/1992 | Inbery et al. | 215/331 |
| 5,213,236 | 5/1993 | Brown | 222/212 |
| 5,339,995 | 8/1994 | Brown et al. | 222/185 |
| 5,409,144 | 4/1995 | Brown | 222/185 |
| 5,655,687 | 8/1997 | Fitten et al. | 222/212 |

*Primary Examiner*—Steven O. Douglas
*Attorney, Agent, or Firm*—Morton S. Simon; Charles J. Zeller

[57] ABSTRACT

A dispensing container comprising a molded plastic bottle and a cap. The molded plastic bottle has a top closed end, a cylindrical side wall, and a shoulder section at a dispensing end of the side wall. The shoulder has one or more indented portions which form the positioning lugs in the shoulder section. The plastic bottle also has a neck with external threads defining a mouth. The cap is selectively connected to the neck. The cap has an internally threaded cuff for interconnection with the external threads of the neck. The cap also has structure for dispensing of an enclosed material which is near the mouth. The cap is cup-shaped with a face and a cylindrical wall extending from the face to define an interior of the cap. When the cap is connected to the neck, the indented portions which form the positioning lugs in the shoulder are hidden from view within the interior of the cap.

12 Claims, 3 Drawing Sheets

DISPENSING CONTAINER WITH CONCEALED LUGS

REFERENCE TO CO-PENDING APPLICATION

Reference is hereby made to the commonly assigned, application entitled DISPENSING CONTAINER WITH TRAVEL CAP (Ser. No. 08/476,858) filed on Jun. 7, 1995, now U.S. Pat. No. 5,655,687.

BACKGROUND OF THE INVENTION

This invention relates to a container and, more particularly, to a dispensing container for selectively dispensing flowable material. The container utilizes lugs which properly orient the container for printing on the container. During use, the lugs are hidden from view in order to add to the overall appearance of the container.

Dispensing containers are known for holding flowable materials, such as bath products, shampoos, conditioners and soaps. Such containers typically have a base for supporting the container and an opening at the opposite end of the base for dispensing product from an inner cavity of the container. A cap usually secures the container during periods of non-use.

In most containers, flowable material gravitates toward the base, which is at the opposite end of the opening of the container. In such containers, when the container is nearly empty, it is difficult to dispense material which is seated at the base opposite the opening. A container which is designed so that the dispensing opening is at the base of the container where the container is supported is useful, because the content, such as shampoo or soap, may be dispensed more readily.

It is necessary to label dispensing containers with information regarding the type of materials contained within. Often, identification information and trademarks are placed on the front of the container, while instructions for use and ingredient and manufacturing information are placed on the back of the container. In order for automated printing machines to determine which side of the container is the front and which side is the back, lugs or indented areas are formed on the outside of the containers. Printing equipment grasps the container by these lugs and orients the container before printing. In this way, printing machines properly orient the container before printing on it allowing rapid and effective printing.

The printing lugs typically must be formed on the outside of the containers where they are readily accessible to automated printing devices. In the past, the lugs have been formed in the closed bottom end of the container. Since the container rests on the bottom, the lugs are normally not visible and do not detract from the appearance of the container. For an improved inverted container that is designed so that the dispensing opening is at the base of the container and the closed end is at the top of the container, however, the lugs are quite visible and detract from the otherwise smooth appearance of the container.

A design wherein an inverted container design with printing lugs could be utilized, while at the same time disguising the lugs from view, would be a useful improvement to the art.

SUMMARY OF THE INVENTION

This invention relates to a dispensing container for selectively dispensing flowable material. The container utilizes lugs hidden from view in order to properly orient the container for printing on the container.

The container comprises a molded plastic bottle and a cap. The molded plastic bottle has a closed end, a cylindrical side wall, and a shoulder section at a dispensing end of the side wall. The bottle has one or more positioning lugs in the shoulder section used for applying printing to the bottle. The bottle also has a neck with external threads defining a mouth.

The cap is selectively connected to the neck of the bottle. The cap has an internally threaded cuff for interconnection with the external threads of the neck of the bottle. The cap also has a dispensing means proximate to the mouth.

The cap is cup-shaped with a face and a cylindrical wall extending from the face to define an interior of the cap. When the cap is connected to the neck, the lugs in the shoulder of the bottle are hidden from view within the interior of the cap.

DETAILED DESCRIPTION OF THE PREFERRED EMBODIMENTS

Figure 1:
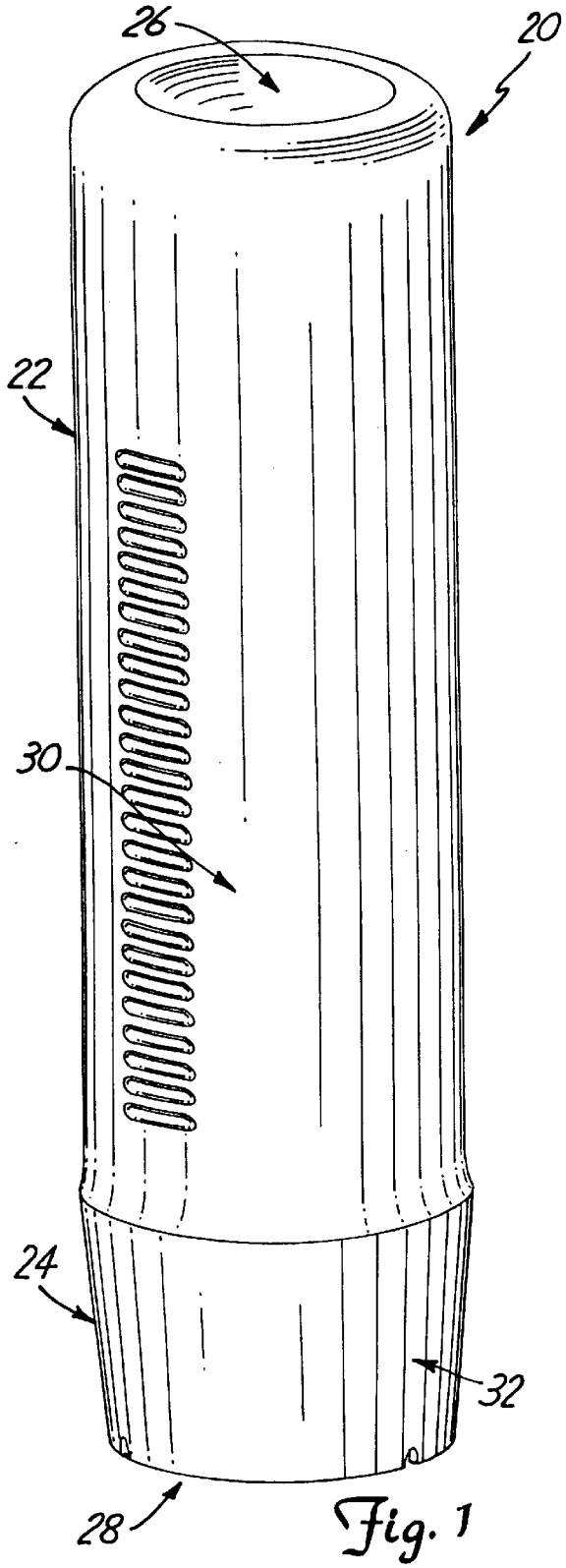
FIG. 1 is a perspective view of the dispensing container of the present invention shown supported at a dispensing end of the container.
Figure 2:
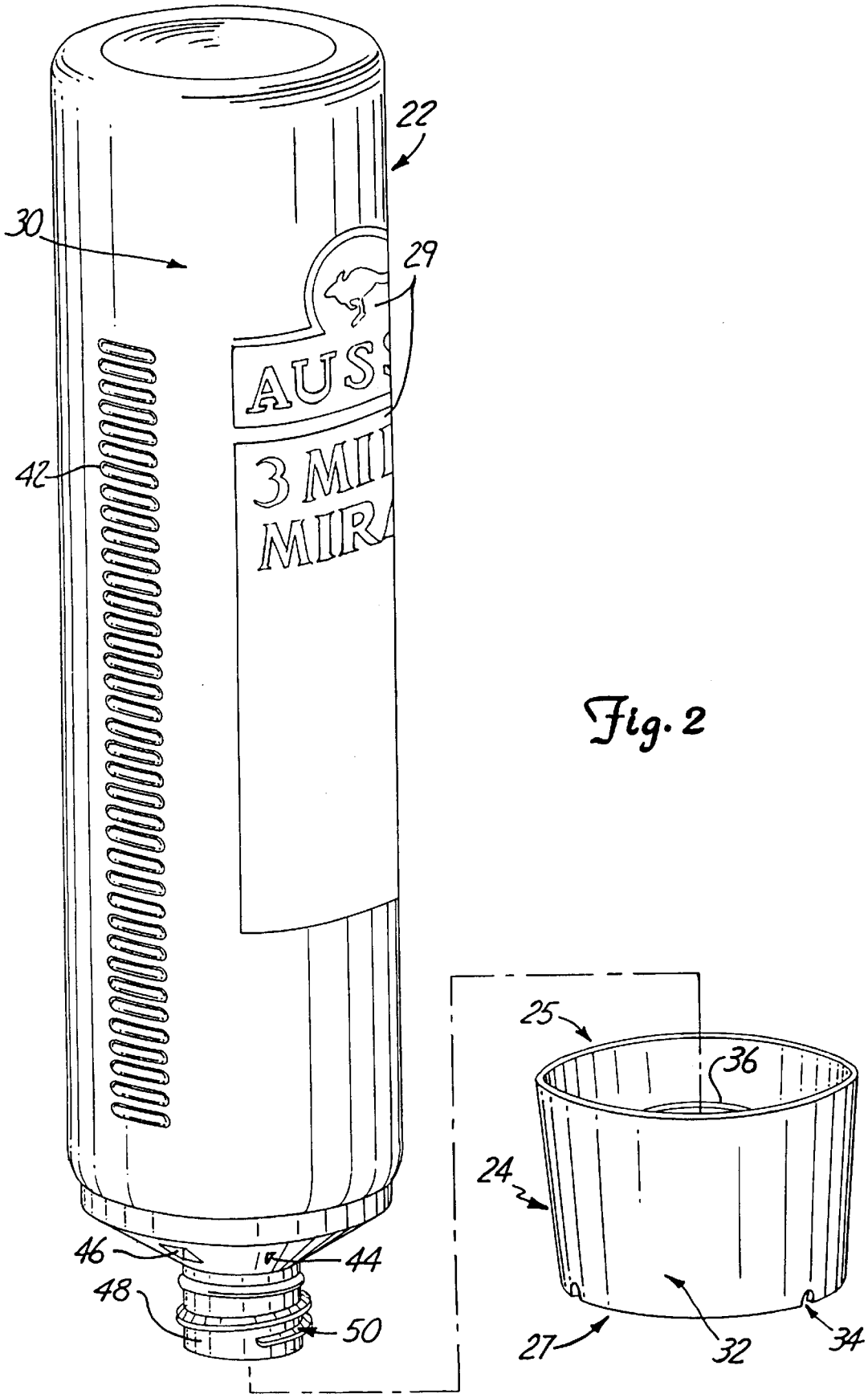
FIG. 2 is a perspective view of a bottle and a cap.
Figure 3:
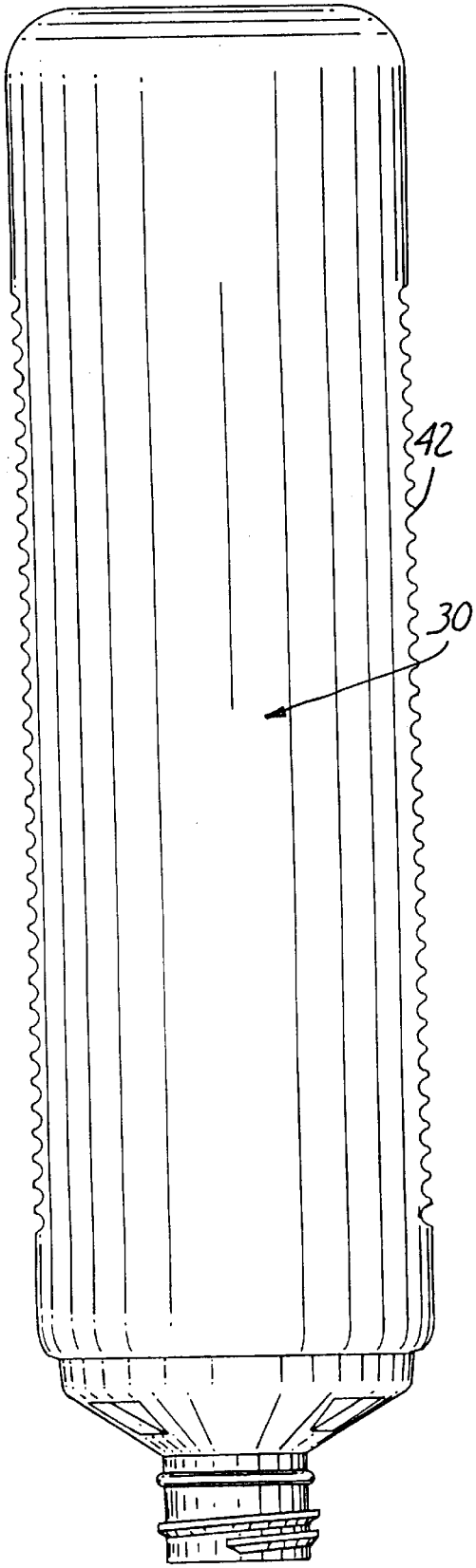
FIG. 3 is a side view of a bottle.

FIGS. 1 and 2 show a dispensing container 20 of the present invention. Dispensing container 20 includes bottle 22 and cap 24 and has closed top end 26 and dispensing bottom end 28. In operation, container 20 stores a flowable material which can be selectively released from container 20 at dispensing bottom end 28.

As shown in FIG. 1, when cap 24 and bottle 22 are interconnected, cap 24 supports bottle 22 in an upright, inverted position to define dispensing bottom end 28 of container 20. In this upright position, gravity forces the flowable material in dispensing container 20 toward cap 24.

As can be seen in FIG. 1, bottle 22 has outer bottle surface 30 and cap 24 has outer cap surface 32. When cap 24 is joined with bottle 22, outer surfaces 30 and 32 adjoin to form a relatively smooth outer surface for container 20. Label 29 is placed on outer surface 30, as shown in FIG. 2. Label 29 may be printed on using silk screened graphics or applied as a pre-printed label.

Figure 4:
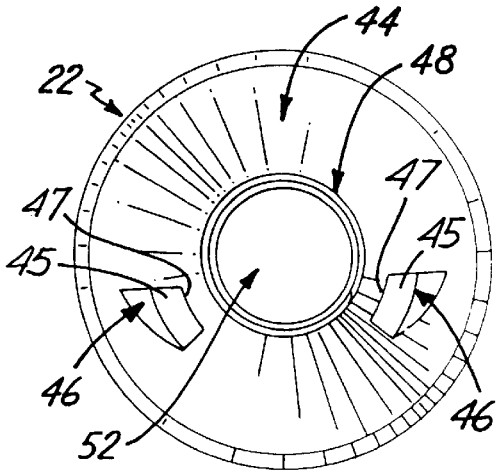
FIG. 4 is an end view of a bottle from an open end of the bottle.

FIGS. 2 and 4 show bottle 22 which includes outer bottle surface 30, label 29, grips 42, shoulder 44, lugs 46, neck 48, threads 50, and opening 52. Outer bottle surface 30 is substantially cylindrically shaped, and terminates into shoulder 44 which gradually slants toward neck 48 and has a substantially smooth surface. Neck 48 is substantially parallel with outer bottle surface 30, but has a significantly smaller diameter. Threads 50 surround neck 48 and are used in the interconnection of bottle 22 with cap 24. Neck 48 defines an opening 52.

Grips 42 alternate raised portions with lowered portions along a narrow strip on opposite sides of bottle 22. Grips 42 allow a user to easily grip container 20, even when it is wet.

Lugs 46 are positioned in shoulder 44 and are indented portions in the otherwise smooth surface of shoulder 44. Lug ramp 45 initiates on the surface of shoulder 44 and gradually ramps down away from the surface of shoulder 44 toward the interior of bottle 22. Lug ramp 45 terminates at lug wall 47 which extends generally perpendicularly to lug ramp 45.

Automated printing machines include ramp-shaped structures that engage lugs 46, and specifically lug walls 47, to position bottle 22 appropriately for printing on outer bottle surface 30 in predetermined locations. Lugs 46 are important in properly positioning bottle 22 so that label 29, or similar printing, is centered between grips 42 and not over grips 42 or over other undesired areas.

Figure 5:
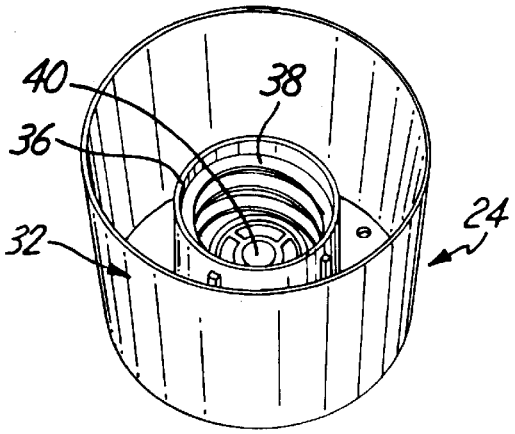
FIG. 5 is an end view of a cap, viewed generally from a connecting end.
Figure 6:
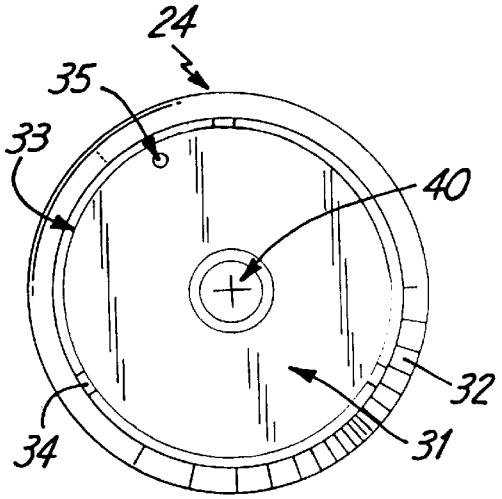
FIG. 6 is an end view of a cap, viewed generally from a dispensing end.
Figure 7:
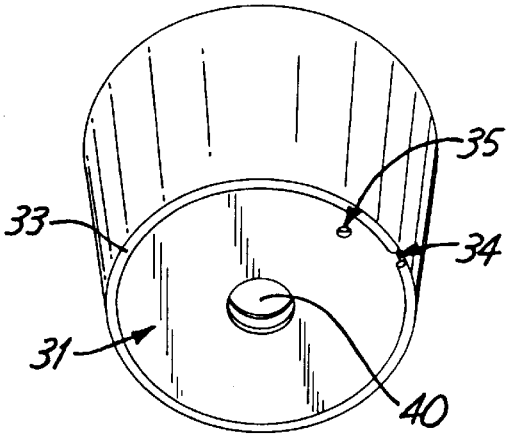
FIG. 7 is a perspective view of a cap.

FIGS. 5–7 show cap 24 which includes dispensing surface 31, outer cap surface 32 (FIGS. 1 and 2), dispensing end ridge 33, drainage notch 34, drainage hole 35, inner cuff 36, inner cuff threads 38, and valve 40. Cap 24 has connecting end 25 and dispensing end 27 (FIG. 2) and is configured such that it can be interconnected with bottle 22 at connecting end 25 in order to form container 20.

Valve 40 of cap 24 selectively holds and dispenses the flowable material in bottle 22 when cap 24 is interconnected with bottle 22. The operation of valve 40 is fully disclosed in previously-filed application entitled "DISPENSING CONTAINER WITH TRAVEL CAP" (Ser. No. 08/476,858 filed Jun. 7,1995), now U.S. Pat. No. 5,655,687, which is incorporated by reference herein.

Dispensing surface 31 is slightly recessed relative to end ridge 33. Thus, when cap 24 is resting on a smooth surface with dispensing surface 31 oriented down toward the smooth surface, only end ridge 33 will contact the smooth surface. Dispensing surface 31 will be slightly set back. Drainage notch 34 prevents a seal from being formed between the smooth surface and end ridge 33. Such a seal would be especially likely where the smooth surface is covered with water. Drainage hole 35 allows any flowable material trapped inside cap 24 to flow out of container 20.

FIG. 2 shows label 29 on outer bottle surface 30. Automatic printing machines are able to print on designated portions of outer bottle surface 30, and thus avoid printing over grips 42 and any other areas where printing is not desired.

Cap 24 interconnects with bottle 22 when threads 38 of cuff 36 are interconnected with threads 50 of neck 48. When cap 24 and bottle 22 are interconnected, valve 40 of cap 24 abuts opening 52 of bottle 22. In this way, the flowable material contained within bottle 22 is alternately dispensed and prevented from flowing through opening 52 by valve 40.

When bottle 22 interconnects with cap 24, outer bottle surface 30 and outer cap surface 32 abut to form a substantially smooth outer surface for container 20. As seen in FIG. 1, outer cap surface 32, outer bottle surface 30, closed top end 26, and dispensing bottom end 28 all are free of lugs or substantially indented portions.

With the interconnection of bottle 22 and cap 24, outer cap surface 32 fully surrounds shoulder 44, lugs 46, neck 48, threads 50, and opening 52 so that they are all hidden from view. Consequently, container 20 has an appearance which is substantially smooth and free from indentations.

Although the present invention has been described with reference to preferred embodiments, workers skilled in the art will recognize that changes may be made in form and detail without departing from the spirit and scope of the invention.

What is claimed is:

1. A dispensing container having a dispensing opening at a bottom of the container comprising:

a molded plastic bottle having a top closed end, a generally cylindrical side wall with a diameter, a shoulder section at a bottom dispensing end of the side wall with at least one indented portion in the shoulder section forming at least one positioning lug which is adapted to engage structures on printing or labelling machines and a neck with external fastening means and a mouth; and a cap selectively connected to the neck, the cap having an internal fastening means for interconnection with the external fastening means of the neck.

2. The dispensing container of claim 1 wherein a dispensing means is proximate to the mouth and wherein the cap is cup-shaped with a face and a side cap wall extending from the face to define an interior of the cap, such that when the cap is connected to the neck the positioning lug in the shoulder is hidden from view within the interior of the cap.

3. The dispensing container of claim 1 wherein the diameter of the cylindrical side wall of the bottle is substantially similar to a diameter of the side cap wall such that the walls form a smooth exterior.

4. The dispensing container of claim 1 wherein the diameter of the cylindrical side wall of the bottle is greater than a diameter of the mouth.

5. The dispensing container of claim 1 wherein the external fastening means comprises external threads on the neck and wherein the internal fastening means comprises an internally threaded cuff.

6. The dispensing container of claim 1, wherein the shoulder section has at least two indented portions.

7. A molded plastic dispensing container comprising a bottle having a top closed end, a generally cylindrical side wall with a diameter, a shoulder section at a bottom dispensing end of the side wall with at least one indented portion in the shoulder section forming at least one positioning lug which is adapted to engage structures on printing or labeling machines, and a neck with external fastening means and a mouth.

8. The molded plastic dispensing bottle of claim 7 further comprising a cap selectively connected to the neck, the cap having an internal fastening means for interconnection with the external fastening means of the neck.

9. The molded plastic dispensing container of claim 7, wherein the shoulder section has at least two indented portions.

10. A dispensing container comprising:

a molded plastic bottle having a top closed top end, a cylindrical side wall with a diameter, the cylindrical side wall extending down from the closed top end, a shoulder section sloping from the cylindrical side wall to a dispensing bottom end, and a neck with external fastening means and a mouth, the shoulder section having at least one indented portion forming at least one positioning lug which is adapted to engage structures on printing or labeling machines; and a cap selectively connected to the neck, the cap having an internal fastening means for interconnection with the external fastening means of the neck.

11. The dispensing container of claim 10 further comprising a pair of lugs positioned in the shoulder section on opposite sides of the neck.

12. The dispensing container according to claim 10, wherein the shoulder section has at least two indented portions.

* * * * *